US008979412B2

(12) United States Patent
Lin

(10) Patent No.: US 8,979,412 B2
(45) Date of Patent: Mar. 17, 2015

(54) TIP UNIT FOR A COSMETIC APPLICATOR

(76) Inventor: Ming-Lang Lin, Tainan (TW)

( * ) Notice: Subject to any disclaimer, the term of this patent is extended or adjusted under 35 U.S.C. 154(b) by 517 days.

(21) Appl. No.: 13/529,825

(22) Filed: Jun. 21, 2012

(65) Prior Publication Data

US 2013/0011178 A1 Jan. 10, 2013

(30) Foreign Application Priority Data

Jul. 8, 2011 (TW) ..... 100212580 U

(51) Int. Cl.

| | |
|---|---|
| ***A46B 15/00*** | (2006.01) |
| ***B43K 29/00*** | (2006.01) |
| ***B43K 5/00*** | (2006.01) |
| ***A45D 40/00*** | (2006.01) |
| ***A45D 40/20*** | (2006.01) |
| ***A45D 34/04*** | (2006.01) |

(52) U.S. Cl.

CPC ..... *A45D 40/20* (2013.01); *A45D 34/04* (2013.01)

USPC ..... 401/263; 401/9; 401/195; 401/205; 132/218; D19/41; D19/42; D19/55

(58) Field of Classification Search

CPC ..... A45D 34/04

USPC ..... 401/9, 10, 17, 24, 119, 195, 199, 198, 401/205, 206, 261, 264; 132/218

See application file for complete search history.

(56) References Cited

U.S. PATENT DOCUMENTS

| | | | | |
|---|---|---|---|---|
| 2,691,184 | A * | 10/1954 | Miller et al. | 401/129 |
| 3,690,777 | A * | 9/1972 | Costa | 401/17 |
| 5,720,563 | A * | 2/1998 | Nakagawa | 401/119 |
| 2009/0010702 | A1 * | 1/2009 | Nehashi | 401/24 |
| 2012/0266907 | A1 * | 10/2012 | Chan | 132/218 |

* cited by examiner

*Primary Examiner* — David Walczak
*Assistant Examiner* — Thomas M Abebe
(74) *Attorney, Agent, or Firm* — Birch, Stewart, Kolasch & Birch, LLP

(57) ABSTRACT

A tip unit of a cosmetic applicator includes a tube portion connected to a hollow body of the cosmetic applicator, and a tip portion tapering away to a point from the tube portion. The tip portion has a passage space contain liquid cosmetics advanced from the hollow body through the tube portion, and has a plurality of flexible blade segments, a plurality of guiding grooves defined respectively by corresponding adjacent pairs of the blade segments, and a plurality of slits, each communicating the passage space with a respective one of the guiding grooves, and being enlargeable when the tip portion is deformed so as to permit flow of the liquid cosmetics from the passage space to the respective one of the guiding grooves therethrough.

4 Claims, 5 Drawing Sheets

TIP UNIT FOR A COSMETIC APPLICATOR

CROSS-REFERENCE TO RELATED APPLICATION

This application claims priority of Taiwanese Application No. 100212580, filed on Jul. 8, 2011.

BACKGROUND OF THE INVENTION

1. Field of the Invention

The invention relates to a tip unit for a cosmetic applicator.

2. Description of the Related Art

A conventional cosmetic applicator, such as an eyeliner brush, has a handle portion and a hair portion. There are several types of eyeliner, one of which is liquid eyeliner, and another of which is non-liquid eyeliner (e.g., powder eyeliner).

To apply liquid eyeliner, the hair portion must first be soaked with liquid eyeliner from such as a liquid dispensing chamber in the handle portion. To apply non-liquid eyeliner (e.g., powder eyeliner), the hair portion must first be dipped in non-liquid eyeliner.

However, regardless of the type of eyeliner, since the hair portion is generally made of strands of fine hair, the hair portion may suffer from loss and splitting of hair, and, on the other hand, may be too soft, rendering uniform application of eyeliner difficult.

SUMMARY OF THE INVENTION

Therefore, the object of the present invention is to provide a tip unit of a cosmetic applicator that is durable and easy to use.

Accordingly, a tip unit of a cosmetic applicator, the cosmetic applicator having an elongated hollow body that contains liquid cosmetics, comprises:

a tube portion having a surrounding wall that has a connecting end adapted to be connected to the hollow body of the cosmetic applicator and a distal end opposite to the connecting end along a longitudinal axis; and a tip portion extending from the distal end of the surrounding wall of the tube portion along the longitudinal axis, configured to have a star-shaped cross section, and tapering away to a point. The tip portion defines a passage space that is adapted to contain the liquid cosmetics advanced from the hollow body of the cosmetic applicator through the tube portion, and has a plurality of outwardly-projecting blade segments that are flexible and that are interposed between the distal end of the surrounding wall of the tube portion and the point, a plurality of guiding grooves, each being defined between a corresponding adjacent pairs of the blade segments, and a plurality of slits, each spatially communicating the passage space with a respective one of the guiding grooves, and being enlargeable when the tip portion is deformed so as to permit flow of the liquid eyeliner from the passage space to the respective one of the guiding grooves therethrough.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
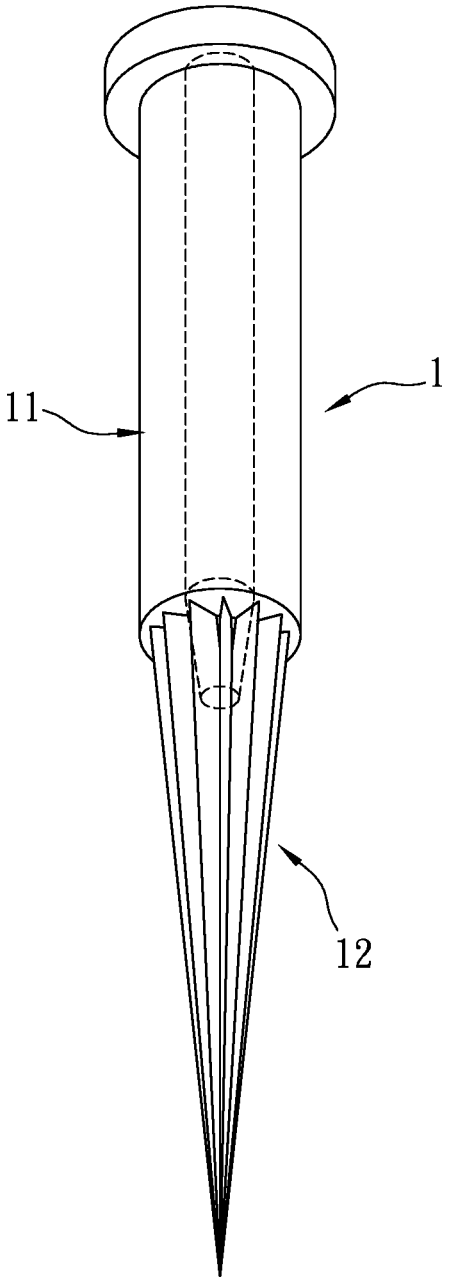
FIG. 1 is a perspective view of a preferred embodiment of a tip unit for a cosmetic applicator, according to the invention.
Figure 2:
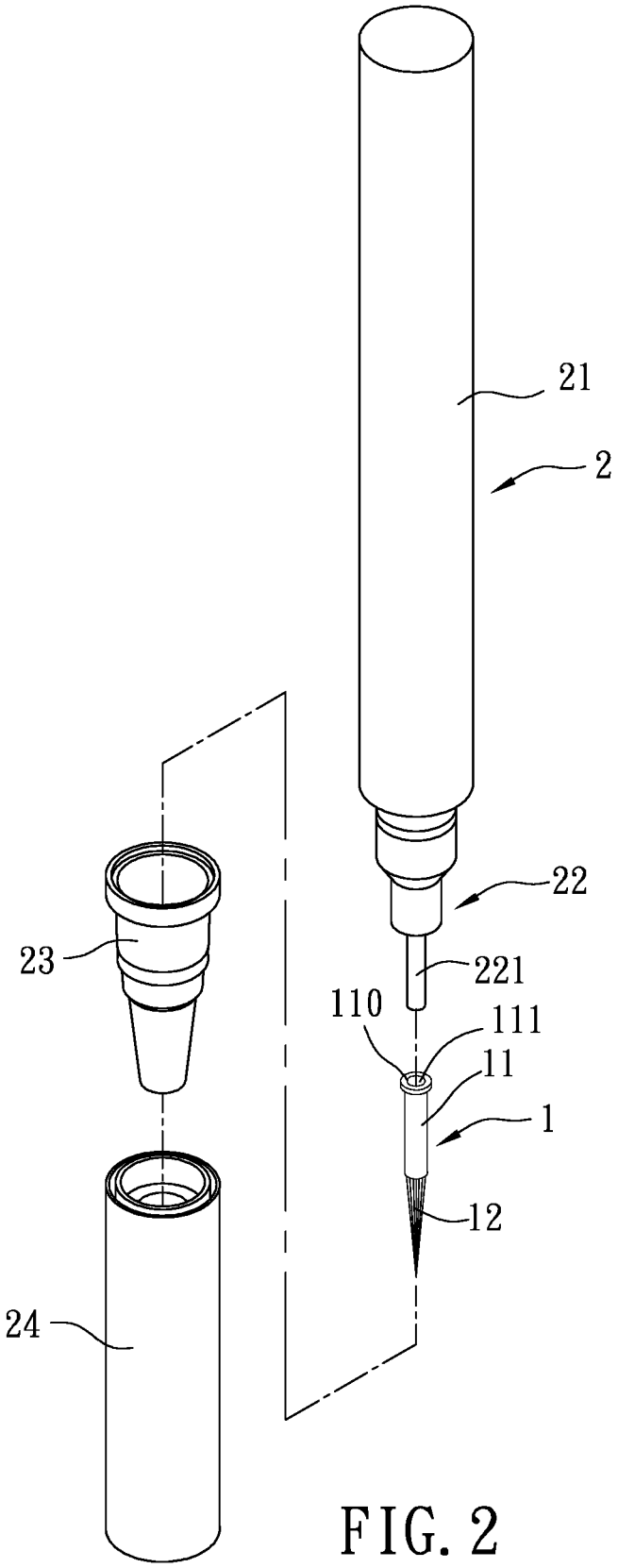
FIG. 2 is an exploded perspective view of the cosmetic applicator.

As shown in FIGS. 1 and 2, a preferred embodiment of a tip unit 1 according to the present invention is a component of a cosmetic applicator 2. The applicator 2 includes: an elongated hollow body 21 containing liquid cosmetic (e.g., liquid eyeliner); a guiding unit 22 that interconnects the hollow body 21 and the tip unit 1 for introducing the liquid cosmetic from the hollow body 21 into the tip unit 1; a hollow frustoconical holding unit 23 that has a first open end connected to the hollow body 21, and a second open end smaller than the first open end and opposite to the first open end along a longitudinal axis 13; and a cap unit 24 for capping the tip unit 1 and the holding unit 23 when the cosmetic applicator 2 is not in use.

The tip unit 1 includes a tube portion 11 and a tip portion 12 that are fluidly connected to each other and that are, in this embodiment, integrally made of thermoplastic polyester elastomer (TPEE).

Figure 4:
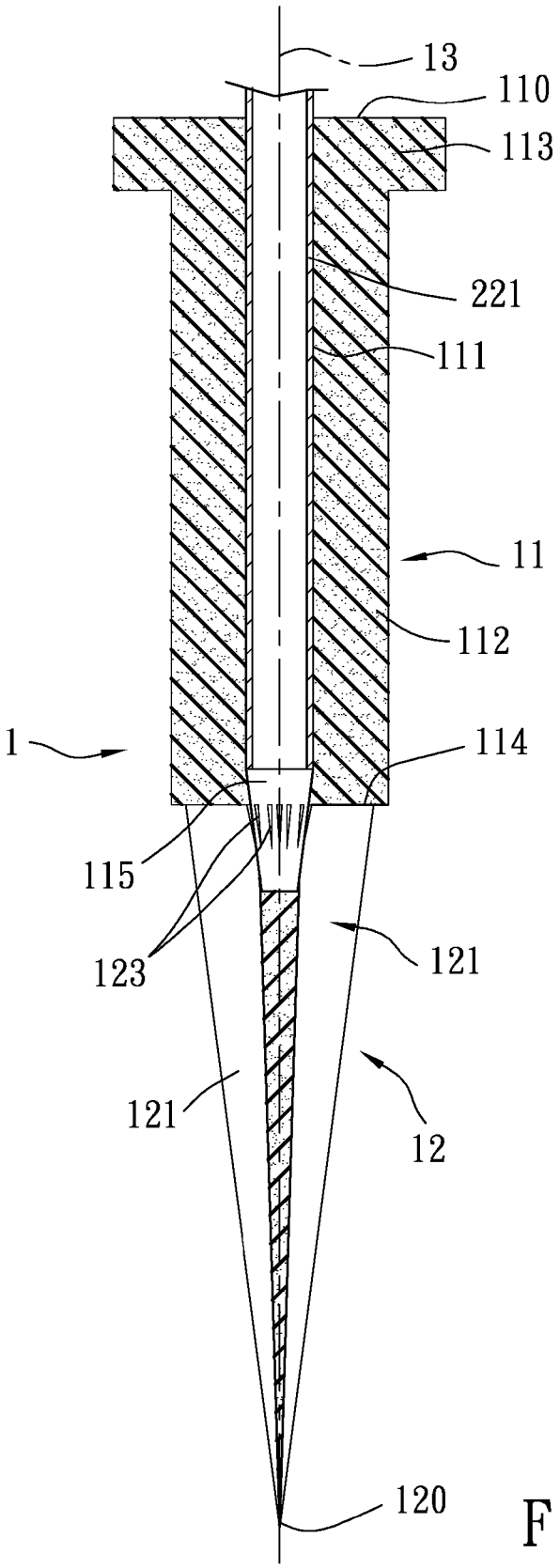
FIG. 4 is a fragmentary sectional view of the cosmetic applicator.

Referring to FIG. 4, the tube portion 11 has a surrounding wall 112 that is disposed concentric to the longitudinal axis 13 and that defines a passage 111 in fluid communication with the hollow body 21, and that has a connecting end 110 adapted to be connected to the guiding unit 22 (see FIG. 2), and a distal end 114 opposite to the connecting end 110 along the longitudinal axis 13. The tube portion 11 further has a flange 113 that extends radially and outwardly from the connecting end 110 of the surrounding wall 112 for engaging the second open end of the holding unit 23 (see FIG. 2). The passage 111 has a converging portion 115 proximate to and converging toward the distal end 114. The guiding unit 22 has a guiding tube 221 extending into the passage 111 through another end of the passage 111, that is opposite to the converging portion 115, for introducing the liquid cosmetic from the hollow body 21 into the tip unit 1 (see FIG. 2).

Figure 3:
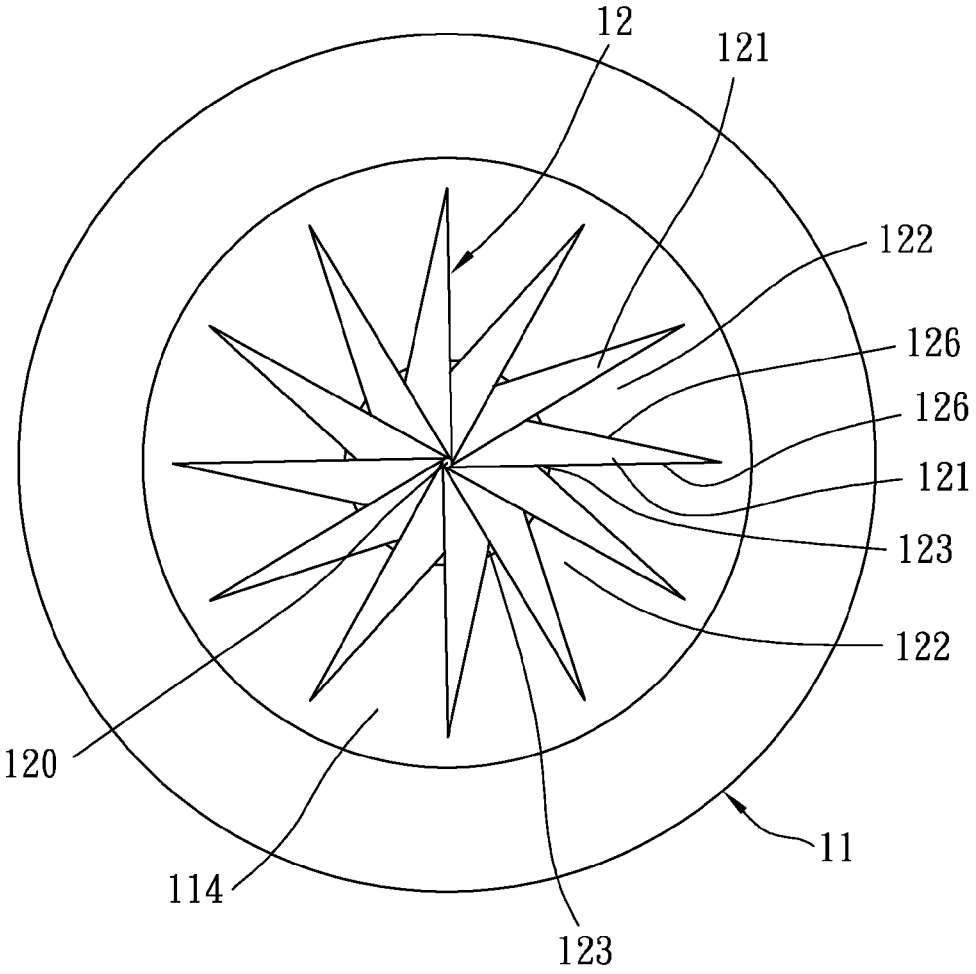
FIG. 3 is a bottom view to illustrate the tip unit.
Figure 5:
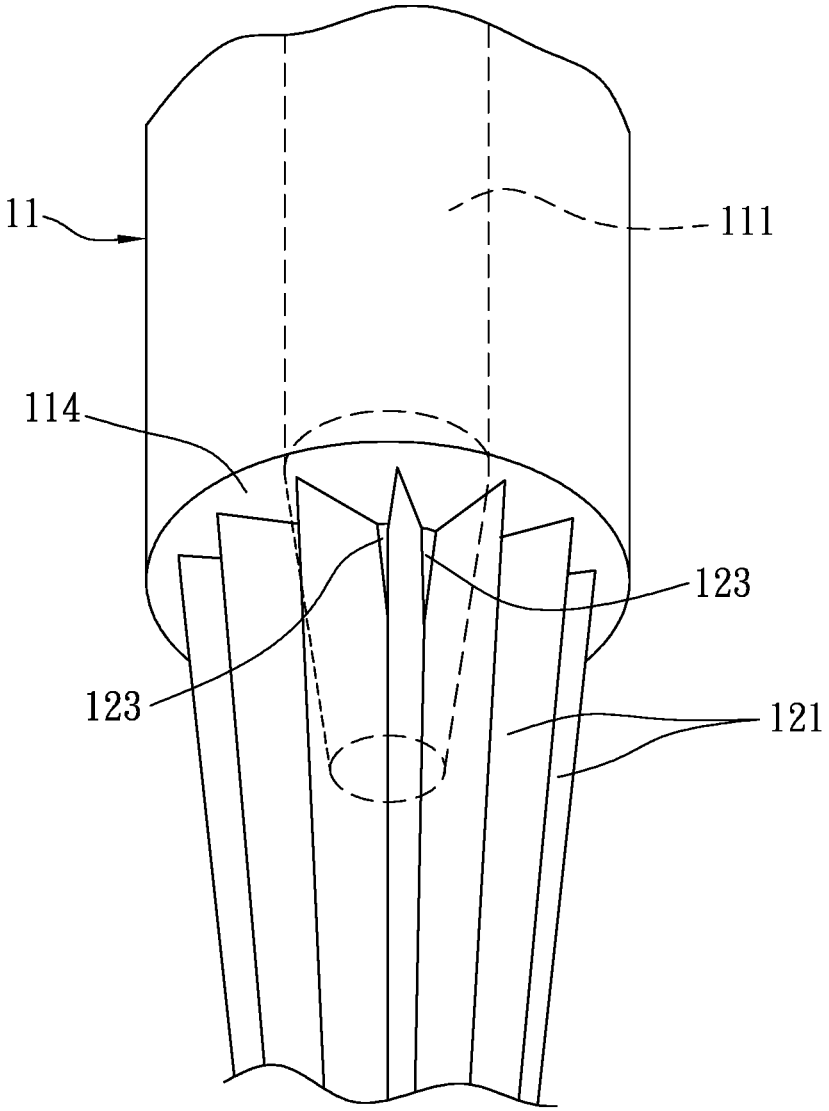
FIG. 5 is a fragmentary perspective view to illustrate the tip unit.

Further referring to FIGS. 3 to 5, the tip portion 12 extends away from the distal end 114 of the surrounding wall 112 of the tube portion 11 along the longitudinal axis 13, is configured with a substantially star-shaped cross section, and tapers away to a point 120. The tip portion 12 defines a passage space for passage of the liquid cosmetic from the guiding tube 221 therethrough, and has: a plurality of blade segments 121 that are flexible and that tapers away from the distal end 114 of the surrounding wall 112 toward the point 120; a plurality of guiding grooves 122, each of which is defined between a corresponding pair of the blade segments 121; and a plurality of slits 123 adjacent to the distal end 114 of the surrounding wall 112.

Specifically, each blade segment 121 has a pair of guiding surfaces 126 that face away from each other. For each of the corresponding pair of the blade segments 121: a guiding groove 122 is defined between a corresponding one of the guiding surfaces 126 of one of the blade segments 121 and a corresponding one of the guiding surfaces 126 of the other of the blade segments 121; and a slit 123 is formed between the blade segments 121 and proximate to the distal end 114 of the tube portion 11 for fluidly communicating the passage space and the corresponding guiding groove 122.

In this embodiment, each of the slits 123 has a predetermined width that is sufficiently small (e.g., 0.05 millimeters) to prevent flow of the liquid cosmetic from the passage space into the corresponding guiding groove 122 therethrough. During use of the applicator 2, as the tip portion 12 is depressed against a surface (e.g., the skin), some of the slits 123 are expanded to permit flow of the liquid cosmetic from the passage space into the corresponding guiding grooves 122 therethrough.

Clumps of the liquid cosmetic formed in the guiding grooves 122 may be easily washed away with water.

In summary, since the tip unit 1 is integrally formed, the tip unit 1 is relatively durable and does not suffer from the drawbacks of the prior art. Moreover, since the blade segments 121 are made of TPEE, which is vastly different from the hair portion of the prior art in terms of resilience, the blade segments 121 may be easier to use in certain applications.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. An applicator tip for a cosmetic applicator, which has a hollow body that is in fluid communication with external environment and that contains liquid cosmetic, said tip unit comprising:

a tube portion having a surrounding wall that has a connecting end adapted to be connected fluidly to the hollow body of the cosmetic applicator and a distal end opposite to said connecting end along a longitudinal axis; and a tip portion extending from said distal end of said surrounding wall of said tube portion along the longitudinal axis, configured with a substantially star-shaped cross section, and tapering away to a point, said tip portion defining a passage space that is adapted to contain the liquid cosmetics advanced from the hollow body of the cosmetic applicator through said tube portion, and having a plurality of outwardly-projecting blade segments that are flexible and that are interposed between said distal end of said surrounding wall of said tube portion and said point, a plurality of guiding grooves each being defined between a corresponding adjacent pairs of said blade segments, and a plurality of slits, each spatially communicating said passage space with a respective one of said guiding grooves, and being enlargeable when said tip portion is deformed so as to permit flow of the liquid cosmetics from said passage space to the respective one of said guiding grooves therethrough.

2. The tip unit as claimed in claim 1, wherein each of said slits has a pre-enlarged width smaller than 0.05 millimeter.

3. The tip unit as claimed in claim 1, the cosmetic applicator further having a hollow frustoconical holding member that has a larger open end connected to the hollow body, and a smaller open end that is disposed under said larger open end and that is opposite to the larger open end along the longitudinal axis, wherein said tube portion further has a flange extending radially and outwardly from said connecting end of said surrounding wall thereof and adapted for engaging the smaller open end of the holding member.

4. The tip unit as claimed in claim 1, wherein said tube portion and said tip portion are formed integrally.

* * * * *